US005139181A

United States Patent [19]

VerWeyst

[11] Patent Number: 5,139,181

[45] Date of Patent: Aug. 18, 1992

[54] DISPENSING FITMENT FOR A CONTAINER

[75] Inventor: Gordon E. VerWeyst, Rockford, Ill.

[73] Assignee: J. L. Clarke, Inc., Rockford, Ill.

[21] Appl. No.: 656,971

[22] Filed: Feb. 19, 1991

[51] Int. Cl.[5] ..... B67D 3/00

[52] U.S. Cl. ..... 222/480; 222/556; 222/565; 220/339; 220/259; 215/237

[58] Field of Search ..... 220/254, 258, 259, 339; 215/237, 341; 222/480, 556, 565

[56] References Cited

U.S. PATENT DOCUMENTS

| | | | |
|---|---|---|---|
| 3,018,931 | 1/1962 | Westgate | 222/480 |
| 4,361,250 | 11/1982 | Foster | 220/339 X |
| 4,494,679 | 11/1985 | Cleevely | 220/339 X |
| 4,693,399 | 9/1987 | Hickman et al. | 220/339 X |
| 4,714,181 | 12/1987 | Kozlowski et al. | 215/237 X |
| 4,793,502 | 12/1988 | Beck | 220/339 X |
| 4,898,292 | 2/1990 | VerWeyst | 215/237 |
| 4,936,494 | 6/1990 | Weidman | 220/339 X |
| 4,955,513 | 9/1990 | Bennett | 220/339 X |

OTHER PUBLICATIONS

Sample Prior Art Fitment with Hinged Door and Interrupted Skirt

*Primary Examiner*—Michael S. Huppert
*Assistant Examiner*—Anthoula Pomrening
*Attorney, Agent, or Firm*—Leydig, Voit & Mayer, Ltd.

[57] ABSTRACT

A fitment made of plastic and adapted to be telescoped over the neck of a jar to facilitate dispensing of the contents of the jar. The fitment includes a top wall having a spoon or pour opening adapted to be selectively closed by a flap which is hinged to the top wall to swing between closed and open positions, the flap being formed with sift holes to allow the contents to be sifted from the jar when the flap is closed. The lower sides of the top wall and the flap are flat and, when the flap is closed, lie in a common plane so as to define a flat and planar surface for supporting and backing a paper-like disc for initially sealing the jar. A circumferentially continuous skirt depends from the top wall and engages a bead on the neck of the jar to hold the fitment on the jar. When the flap is closed, a lift tab on the flap fits into a notch in the top wall and overlies an arcuate section of the skirt.

5 Claims, 3 Drawing Sheets

DISPENSING FITMENT FOR A CONTAINER

BACKGROUND OF THE INVENTION

This invention relates to a fitment for a bottle, jar or the like for holding spices and similar food products. A fitment of this general type is disclosed in Westgate U.S. Pat. No. 3,018,931.

The fitment of the Westgate patent is made of a single piece of resiliently yieldable plastic and includes a circular top wall with an annular skirt depending therefrom. The skirt is adapted to telescope and interlock with the neck of the jar to hold the fitment on the neck. A generally semi-circular dispensing opening is formed through the top wall and is adapted to be selectively closed by a generally similarly shaped flap which is swingably connected to the top wall by a so-called living hinge. By swinging the flap upwardly to an open position, the contents of the jar may be either poured from or spooned out of the ar through the dispensing opening. Small holes are formed through the flap to enable the product to be sifted from the jar when the flap is closed.

In the Westgate fitment, the flap is releasably held in its closed position by means of a rib on the underside of the flap and spaced a substantial distance from the free edge of the flap. When the flap is closed, the rib projects below and releasably engages a catch defined on the periphery of the dispensing opening. As a result of this arrangement, the underside of the fitment is shaped as a stepped configuration and does not lend itself to providing satisfactory support and backing for a sealing disc which serves as a freshness and tamper-evident seal. Moreover, the total area of the dispensing opening is comparatively small in relation to the diameter of the fitment.

While other fitments accommodate a sealing disc and have a hinged flap, the flap and the dispensing opening are very small. Moreover, the skirt is interrupted near the free edge of the flap and is not circumferentially continuous.

SUMMARY OF THE INVENTION

One of the aims of the present invention is to provide a new and improved fitment of the above general type in which the undersides of the top wall and the flap lie substantially in a single plane so as to define a flat and planar surface for reliably supporting and backing a sealing disc in the fitment.

Another object of the invention is to provide a fitment in which the area of the dispensing opening is relatively large for a fitment of a given diameter and in which the skirt is circumferentially continuous around its entire length in order to avoid a break in the skirt in the vicinity of the free edge of the flap.

A more detailed object is to achieve the foregoing through the provision of a fitment in which catches projecting radially from the free edge of the flap coact with similar catches near the dispensing opening to hold the flap closed and in which a lift tab engages an upper section of a circumferentially continuous skirt to prevent the flap from swinging downwardly into the dispensing opening.

The invention also resides in making the hinge of the flap of a non-uniform thickness in order to reduce the tendency of the memory of the hinge to cause the flap to pop open.

These and other objects and advantages of the invention will become more apparent from the following detailed description when taken in conjunction with the accompanying drawings.

DETAILED DESCRIPTION OF THE PREFERRED EMBODIMENT

Figure 1:
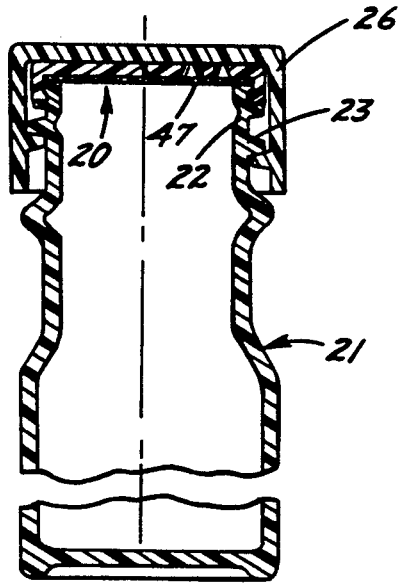
FIG. 1 is a fragmentary cross-sectional view of a typical jar equipped with a new and improved fitment incorporating the unique features of the present invention, the fitment being shown as initially covered by a screw-on cap.
Figure 4:
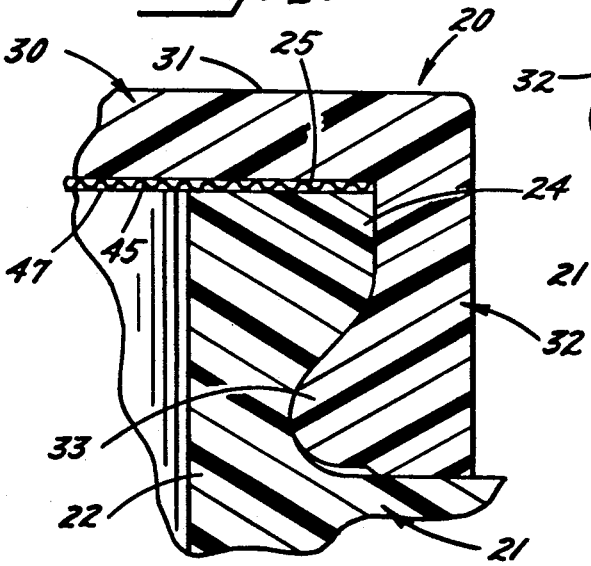
FIG. 4 is an enlarged fragmentary view of a portion of the jar and the fitment shown in FIG. 1.

For purposes of illustration, the invention has been shown in the drawings as embodied in a closure in the form of a fitment 20 for enabling a product such as spice to be dispensed from a container 21. Herein, the container is a glass or plastic jar having a cylindrical neck 22 with an external thread 23 and an upper external bead 24 (FIG. 4) whose upper end defines a sealing lip 25. The fitment 20 is telescoped snugly with the neck 22 and is intended to remain permanently with the jar 21. Normally, the fitment is covered by a conventional screw-on plastic cap 26 (FIG. 1) which may be unscrewed from the thread 23 and removed from the jar so as to expose the fitment and enable dispensing of the contents of the jar.

Figure 2:
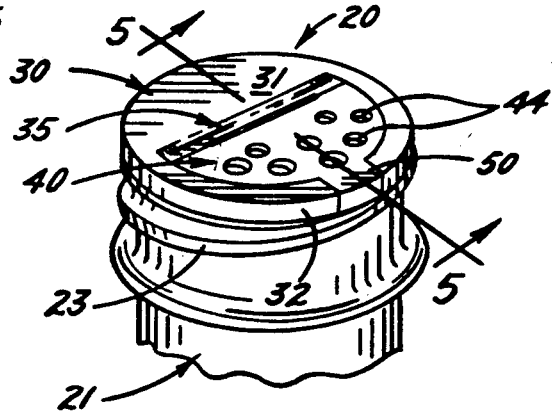
FIG. 2 is a perspective view showing a portion of the jar with the cap removed and with the flap of the fitment in its closed position.
Figure 5:
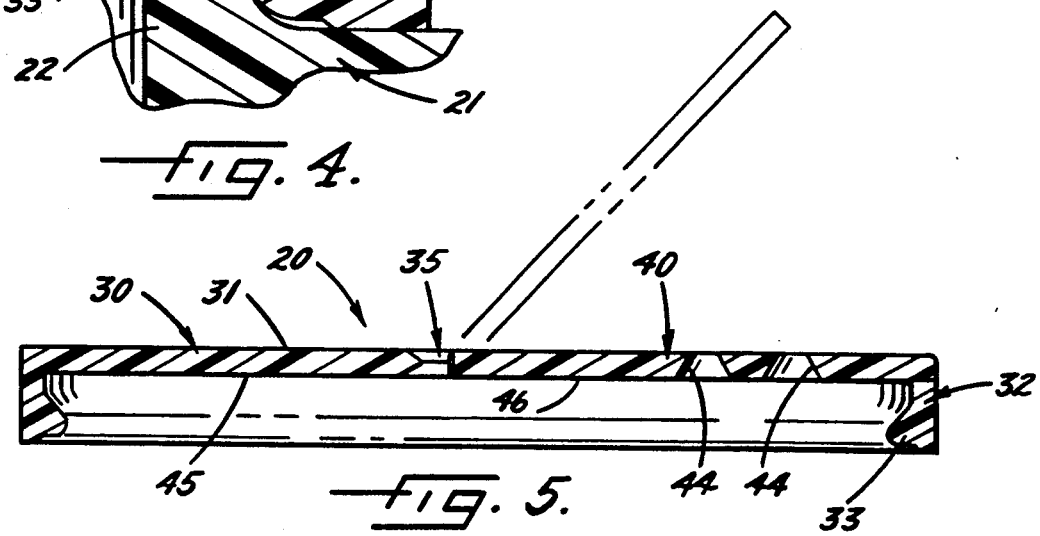
FIG. 5 is an enlarged fragmentary cross-section taken substantially along the line 5—5 of FIG. 2, the jar and the sealing disc being omitted.
Figure 6:
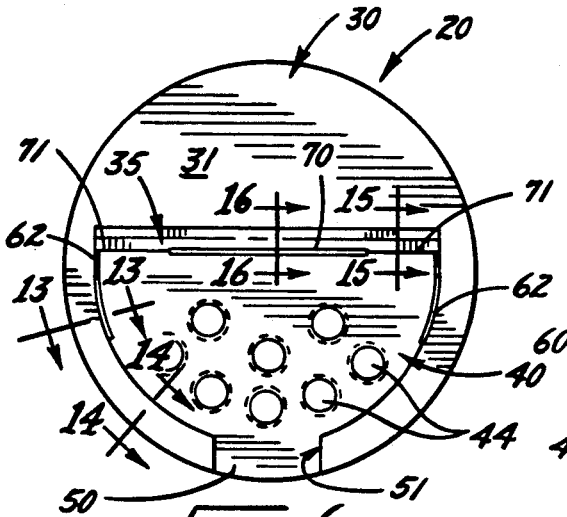
FIG. 6 is an enlarged top plan view of the fitment with the flap closed.

The fitment 20 is circular, is of one-piece construction and is molded of resiliently yieldable plastic such as polypropylene. As shown in FIGS. 2 and 5, the fitment includes a circular top wall 30 formed with a substantially flat upper surface 31. Depending from the outer periphery of the top wall 30 is an annular skirt 32 of short axial length. An appropriately shaped rib 33 (FIG. 4) projects inwardly from the lower end portion of the skirt and is adapted to lock beneath the upper bead 24 of the jar 21 with a snap fit when the fitment 20 is pressed into place by telescoping the skirt over the neck 22 of the jar.

Figure 3:
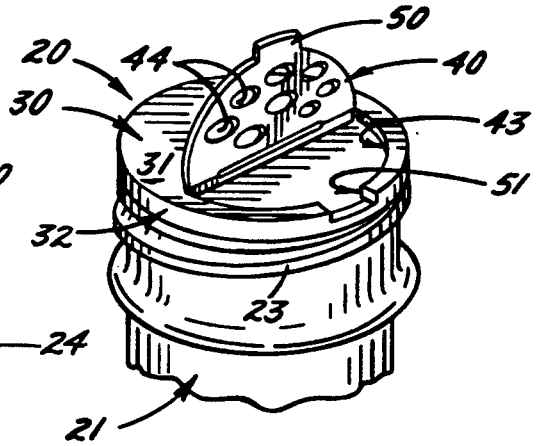
FIG. 3 is a view similar to FIG. 2 but shows the flap in its open position.
Figure 7:
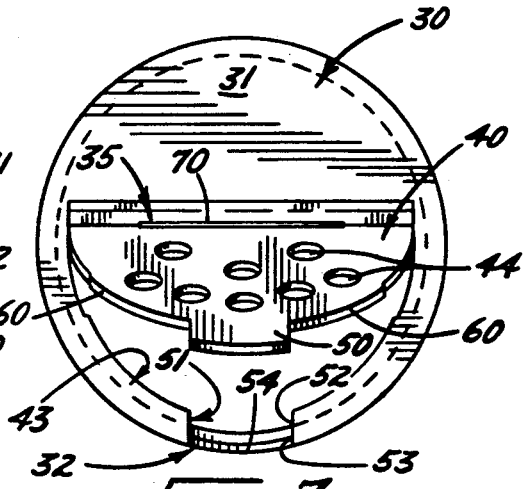
FIG. 7 is a view similar to FIG. 6 but shows the flap open.
Figure 8:
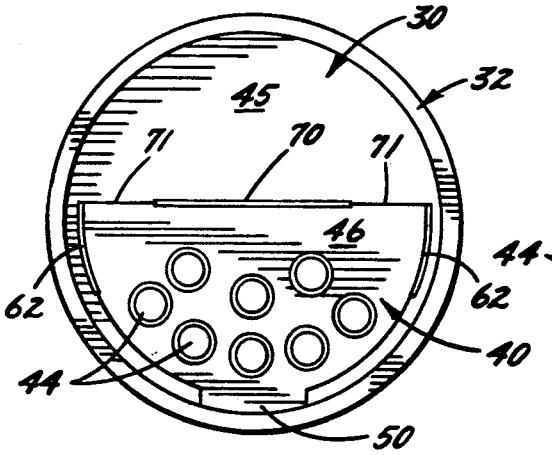
FIG. 8 is an enlarged bottom plan view of the fitment with the flap closed.
Figure 9:
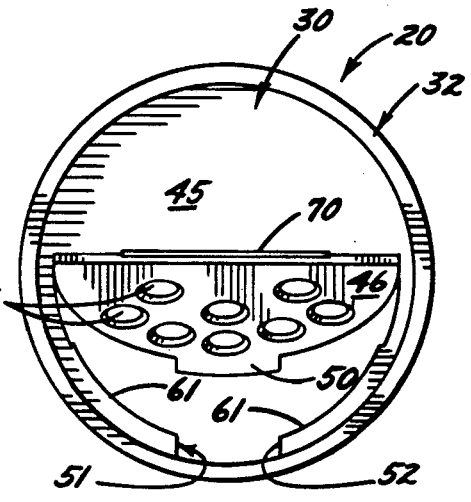
FIG. 9 is a view similar to FIG. 8 but shows the flap open.
Figure 10:
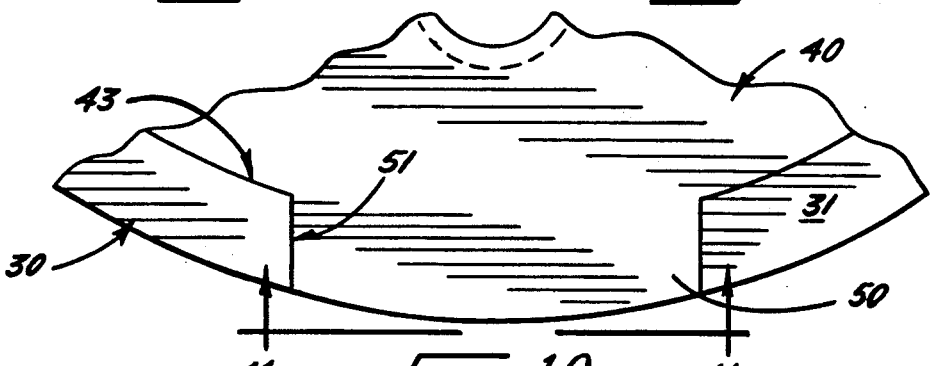
FIG. 10 is a greatly enlarged top plan view of a portion of the fitment and showing the lift tab and part of the flap, the flap being illustrated in its closed position.
Figure 11:
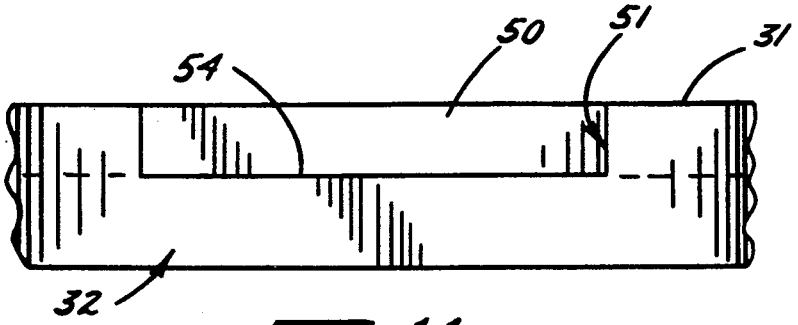
FIG. 11 is a front elevational view as seen substantially along the line 11—11 of FIG. 10.

A groove 35 (FIGS. 2 and 5) is formed in the upper side 31 of the top wall 30 along a chord thereof and defines a living hinge for a flap 40 which is adapted to be swung between open and closed positions. While the hinge 35 could lie along a major chord (i.e., a diameter) of the top wall, it herein extends along a chord which is offset slightly from a diameter so that the area of the fitment 20 on one side of the hinge is somewhat greater than the area on the other side of the hinge. A dispensing opening 43 (FIGS. 3, 7 and 9) is formed through the side of largest area and is generally semi-circular in shape. The flap 40 is of the same shape as the dispensing opening 43 and is adapted to close the opening. When the flap is swung to its open position shown in FIGS. 3, 7 and 9, a spoon may be inserted into the opening to remove the contents of the jar 21 or, alternatively, the contents may be poured out of the jar through the opening.

Several small holes 44 may be formed vertically through the flap 40. When the flap is in its closed position, the contents of the jar 21 may be dispensed by sifting the contents through the holes 44. Sift holes (not shown) also may be formed through the stationary area of the top wall 30, either in lieu of or in addition to the sift holes 44.

In accordance with one aspect of the present invention, both the lower side 45 of the top wall 30 and the lower side 46 of the flap 40 are flat across their entire areas (see FIG. 5). When the flap 40 is in its closed position, the lower side 46 of the flap and the lower side 45 of the top wall 30 lie in a common horizontal plane and define a flat and planar surface for firmly supporting and backing a laminated disc or liner 47 (FIGS. 2 and 4) for engaging the upper lip 25 and initially sealing the jar 21. The disc establishes both a freshness seal and a tamper-evident sear for the jar. When the flap 40 is first opened, that portion of the sealing disc underlying the dispensing opening 42 is torn away so as to expose the opening.

The sealing disc 47 is circular and its diameter is just very slightly smaller than the diameter across the inner periphery of the skirt 32 so that the disc extends across the lip 25 and covers virtually the entire circular area bounded by the skirt, such area being flat and planar as a result of the flat lower sides 45 and 46 of the top wall 30 and the flap 40 lying in a common plane when the flap is closed. The sealing disc is punched out of a sheet of material and is simultaneously pressed into the fitment 20 prior to assembly of the fitment with the jar 21. Being backed by the planar surfaces 45 and 46, the disc is not subjected to wrinkling or distortion when the disc is pressed into the fitment or when the fitment is assembled with the jar. The lower peripheral edge portion of the disc engages the upper end of the rib 33 so as to captivate the disc loosely in the fitment prior to the time the fitment is assembled with the jar.

Figure 12:
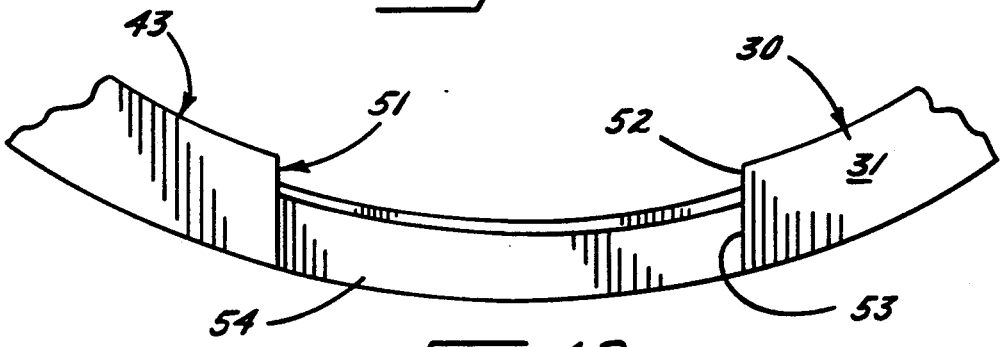
FIG. 12 is a view similar to FIG. 10 but with the flap open.

A lift tab 50 (FIG. 3 and FIGS. 6 to 10) projects from the free edge of the flap 40 midway between the ends thereof and extends perpendicular to the hinge 35. When the flap is closed, the lift tab is received in a notch 51 (FIGS. 7 and 12) in the top wall 30. An inner portion 52 of the notch extends completely through the top wall 30 in communication with the dispensing opening 43 and accommodates an inner portion of the lift tab. An outer portion 53 of the notch is formed in the top wall to a depth equal to the thickness of the top wall and overlies an arcuate section 54 of the skirt 32. When the flap 40 is closed, the outer portion of the tab 50 is received in the outer portion 53 of the notch 51 and engages the upper side of the arcuate section 54 of the skirt 32 to restrict the flap from swinging downwardly into the dispensing opening 43. Because the outer portion 53 of the notch 51 is formed in overlying relation with the skirt 32 and receives the outer portion of the lift tab 50, the periphery of the dispensing opening 43 may be located in very close proximity to the skirt so as to enable the dispensing opening to be large in relation to the available area of top wall. Also, the skirt is not interrupted to accommodate the lift tab but instead is continuous around the entire circumference of the fitment. As a result, the skirt is free of ends which tend to separate and loosen the grip of the skirt on the bead 24.

Figure 13:
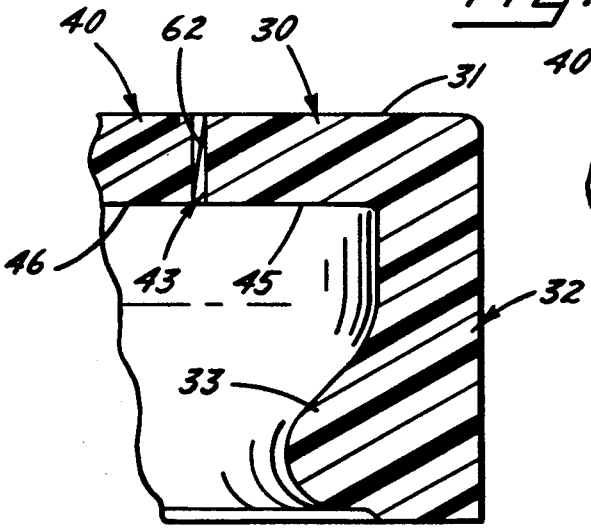
FIGS. 13, 14, 15 and 16 are greatly enlarged cross-sections taken substantially along the lines 13—13, 14—14, 15—15 and 16—16, respectively, of FIG. 6.
Figure 14:
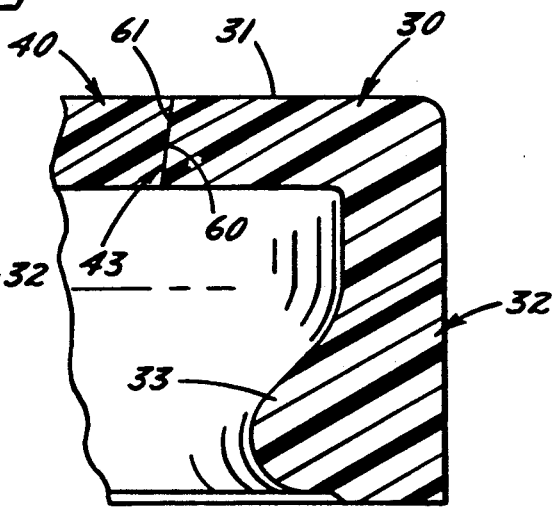

To hold the flap 40 releasably in its closed position while still enabling the underside of the fitment 20 to be flat and planar, radially extending lips 60 (FIG. 7) of very narrow radial width are formed along the free edge of the flap on opposite sides of the tab 50. Each lip 60 lies in the plane of the flap and extends from the tab through an arc equal to approximately one-half the arc between the tab and the adjacent end of the hinge 35. The lips 60 coact with radially narrow fins 61 (FIG. 9) which are co-extensive in length with the lips and which project radially inwardly from the periphery of the opening 43 on opposite sides of the notch 51, the fins being located in the plane of the top wall 30. When the flap 40 is swung closed, the lips 60 flex past and then snap beneath the fins 61 in order to hold the flap releasably in its closed position with the entirety of the flap disposed in the dispensing opening 43. Because the lips 60 and fins 61 are located in the planes of the flap 40 and the top wall 30, respectively, the lips and fins do not interrupt the flat and planar nature of the underside of the fitment 20. The projecting lips and fins result in very narrow gaps 62 (FIGS. 6 and 13) being left between the flap and the periphery of the dispensing opening along arcs extending from the hinge to the lips and fins.

Figure 15:
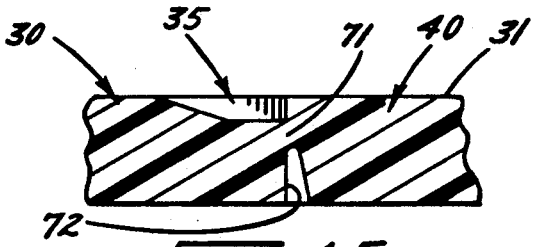
Figure 16:
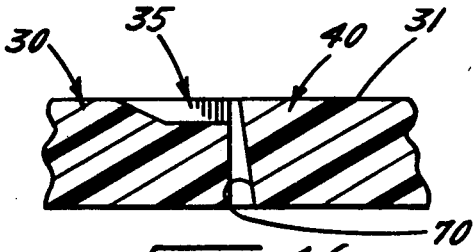

When initially molded, the flap 40 is inclined rearwardly at an angle of about 45 degrees relative to the top wall 30 for the advantageous purposes disclosed in Foster U.S. Pat. No. 3,675,812. When the flap is closed, the memory of the hinge 35 tends to restore the flap to its originally molded position. In order to resist popping open of the flap, the memory of the hinge is decreased by reducing the thickness of the hinge along its midportion. In this instance, the midportion of the hinge is defined by a slot 70 (FIGS. 6 to 9 and FIG. 16) which extends completely through the plastic and thus the flap is connected to the top wall only by webs 71 (FIGS. 6, 8 and 15) of predetermined thickness adjacent the two ends of the hinge and defined by forming grooves 72 (FIG. 15) in the underside of the fitment at the ends of the slot. Alternatively, the midportion of the hinge could be formed by a web having a thickness less than the thickness of the webs 71 at the end portions of the hinge in order to avoid the existence of a through-slot in the fitment. In either case, the spring action of the hinge is decreased in order to reduce the tendency of the flap to pop open.

I claim:

1. A snap-on fitment for a container having an upwardly opening neck, said fitment being circular and being made of a single piece of resiliently yieldable plastic, said fitment comprising a circular top wall having a flat lower side and having an outer periphery, an annular and circumferentially continuous skirt depending from the outer periphery of said top wall and having an unthreaded inner periphery adapted to telescope slidably over said neck, a rib on the inner periphery of said skirt and adapted to lock against said neck with a snap fit to hold said fitment on said neck, a hinge formed in said top wall along a chord thereof and having opposite ends, a generally semi-circular dispensing opening formed through said top wall on one side of said hinge, a generally semi-circular flap integral with said hinge and swingable upwardly and downwardly about said hinge between closed and open positions with respect to said dispensing opening, the entirety of said flap being received within said opening when said flap is in said closed position, said flap having a flat lower side which, when said flap is in said closed position, lies in substantially the same plane as the flat lower side of said top wall, a circular sealing disc lying face-to-face against and backed by the flat lower sides of said top wall and said flap when said flap is in said closed position, said sealing disc having a peripheral edge located in close proximity to the inner periphery of said skirt, said flap including a free edge having ends located at the end of said hinge, a lift tab projecting from the free edge of the flap and located midway between the ends of the free edge, a notch for receiving said lift tab when said flap is in said closed position, said notch having an inner portion formed through said top wall and communicating with said dispensing opening and having an outer portion formed in said top wall and overlying an arcuate section of said skirt, and said lift tab having an outer end portion located in the outer portion of said notch and engaging said arcuate section of said skirt to restrict said flap from swinging downwardly beyond said plane and into said dispensing opening.

2. A fitment as defined in claim 1 in which said lift tab has an inner end portion and a flat lower side, the lower sides of said top wall, said flap and the inner end portion of said lift tab defining a flat and planar circular area when said flap is in said closed position, said circular area being coincident with the area bounded by the inner periphery of said skirt.

3. A fitment as defined in claim 1 further including arcuate fins of narrow width projecting radially inwardly from the periphery of said opening on opposite sides of said notch, and arcuate lips of narrow width projecting radially outwardly form the free edge of said flap on opposite sides of said lift tab and adapted to snap beneath said fins to hold said flap releasably in its closed position.

4. A fitment as defined in claim 1 in which said hinge has two end portions and a middle portion located between said end portions, the thickness of said end portions being greater than the thickness of said middle portion so as to reduce the tendency of said flap to spring upwardly from said closed position.

5. A fitment as defined in claim 4 in which the middle portion of said hinge is defined by a slot formed completely through said top wall.

* * * * *